US008661759B2

(12) United States Patent
Kalkanoglu

(10) Patent No.: US 8,661,759 B2
(45) Date of Patent: Mar. 4, 2014

(54) SHINGLE LAYER OR SHINGLE HAVING THICK APPEARANCE

(75) Inventor: Husnu M. Kalkanoglu, Swarthmore, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 13/609,785

(22) Filed: Sep. 11, 2012

(65) Prior Publication Data

US 2013/0000240 A1 Jan. 3, 2013

Related U.S. Application Data

(60) Division of application No. 13/241,413, filed on Sep. 23, 2011, now Pat. No. 8,302,358, which is a division of application No. 13/168,179, filed on Jun. 24, 2011, now Pat. No. 8,281,539, which is a division of application No. 12/712,705, filed on Feb. 25, 2010, now Pat. No. 7,971,406, which is a continuation of application No. 11/215,086, filed on Aug. 30, 2005, now abandoned.

(51) Int. Cl.
*E04D 1/22* (2006.01)
*E04D 1/28* (2006.01)

(52) U.S. Cl.
USPC ..... 52/518; 52/551; 52/554; 52/540; 428/143; 156/62.2; 156/71

(58) Field of Classification Search
USPC ..... 52/518, 314, 315, 5, 555, 559, 557, 52/745.19, 553, 560, 551, 540, 554; 428/143–150; 156/71
See application file for complete search history.

(56) References Cited

U.S. PATENT DOCUMENTS

| | | | | | |
|---|---|---|---|---|---|
| 2,490,430 | A * | 12/1949 | Greider al. | 428/143 |
| 3,624,975 | A * | 12/1971 | Morgan et al. | 52/105 |
| 4,717,614 | A * | 1/1988 | Bondoc et al. | 428/143 |
| 4,795,661 | A * | 1/1989 | Bondoc et al. | 427/187 |
| 5,232,530 | A * | 8/1993 | Malmquist et al. | 156/78 |
| 5,426,902 | A * | 6/1995 | Stahl et al. | 52/314 |
| 5,571,596 | A * | 11/1996 | Johnson | 428/143 |
| 6,195,951 | B1 * | 3/2001 | Stahl et al. | 52/314 |
| 6,305,138 | B1 * | 10/2001 | Stahl et al. | 52/314 |
| 6,813,866 | B2 * | 11/2004 | Naipawer, III | 52/518 |
| 6,895,724 | B2 * | 5/2005 | Naipawer, III | 52/748.1 |
| 2005/0204675 | A1 * | 9/2005 | Snyder et al. | 52/555 |
| 2010/0192501 | A1 * | 8/2010 | Koch et al. | 52/557 |

* cited by examiner

*Primary Examiner* — Jeanette E. Chapman
(74) *Attorney, Agent, or Firm* — Paul & Paul

(57) ABSTRACT

A shingle layer of shingle is provided having an increased thickness adhesive coating on at least a portion of its rear surface, with granules embedded therein, with the granules being of a size range that is larger than the fine particles normally applied to the rear surface of a shingle layer.

9 Claims, 3 Drawing Sheets

Fig. 4
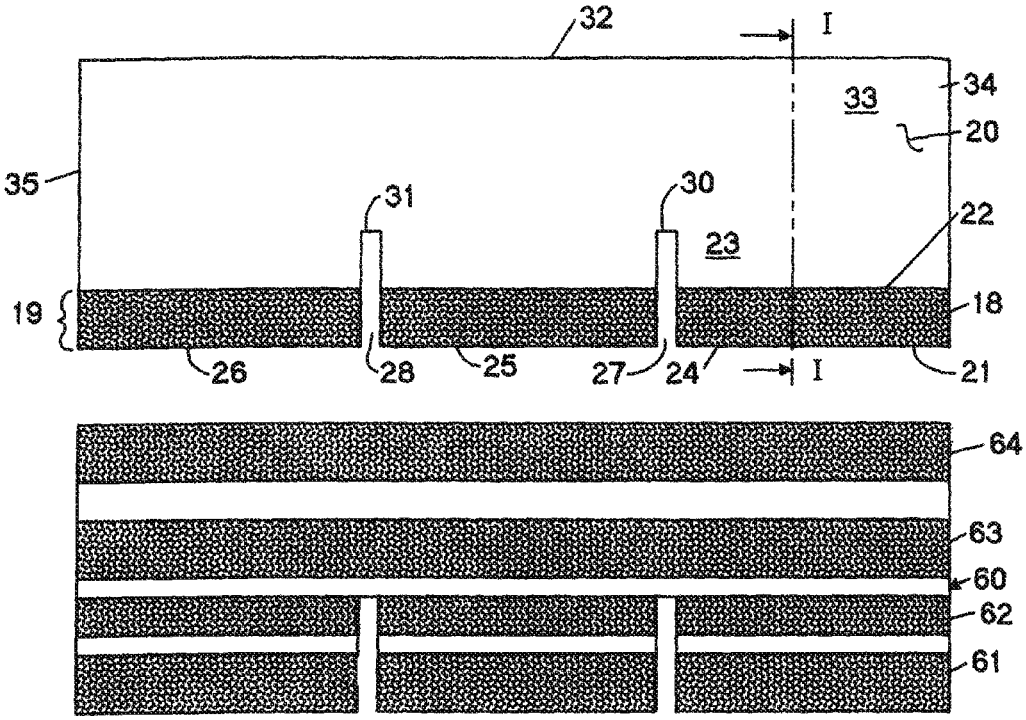
Fig. 5
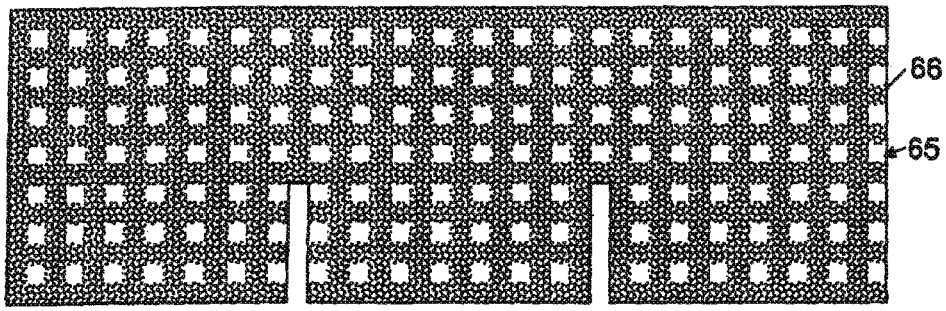
Fig. 6

SHINGLE LAYER OR SHINGLE HAVING THICK APPEARANCE

CROSS-REFERENCE TO RELATED APPLICATION

This is a divisional of U.S. application Ser. No. 13/241,413 filed Sep. 23, 2011, which in turn is a divisional of U.S. application Ser. No. 13/168,179, filed Jun. 24, 2011, which in turn is a divisional and continuation application of U.S. application Ser. No. 12/712,705 filed Feb. 25, 2010, which, in turn is a continuation of U.S. application Ser. No. 11/215,086 filed Aug. 30, 2005, now abandoned.

BACKGROUND OF THE INVENTION

This invention relates to providing a shingle or shingle layer of increased thickness, whether the shingle layer comprises a single layer shingle, or a single layer of a multiple-layer shingle.

Shingles are generally made by providing a bitumen-coated web, with the web being either of organic or inorganic (generally fiberglass) material. The bitumen is generally asphalt. The front or top surface of the shingle or shingle layer is provided with granules, generally of a certain predetermined size, which granules are embedded in the asphalt or other bitumen that coats the web. The construction and arrangement of such granules can take on various forms, for various purposes, such as color, light reflection, fungus-resistance, ultra-violet or infrared reflectiveness, or of any other forms, for facilitating the longevity of the shingle, or simply for aesthetic purposes. Where aesthetics are important, the granules can be various combinations of colored granules, or various arrangements of color, all of which are known in the art.

The bottom or rear surface of the shingle is generally provided with a very thin layer of adhesive, such as asphalt or other bitumen coating. Fine particles are applied to this very thin layer of adhesive coating on the bottom, or rear surface of the shingle. Such fine particles can include sand, limestone, talc, mica, etc. embedded in the fine adhesive coating.

Attempts have been made to produce shingles having ordinary roofing granules embedded in this thin layer of adhesive coating on the rear surface of the shingle. However, if granules of an approximate size such as those that are used on the front or top surface of the shingle or shingle layer are used, to be embedded in the very thin layer of adhesive coating that is applied to the rear of the shingles, the adhesion provided by the thin layer of coating is not sufficient to ensure that the granules will remain embedded in the thin layer of adhesive coating, such that such granules on the rear surface of the shingle can become loose, creating safety issues on the roofing by acting like small roller bearings under the feet of the contractor or other installer, potentially causing slipping, sliding and accidents.

THE PRESENT INVENTION

In accordance with the present invention, a shingle layer is constructed in the usual manner, except that on a portion of the rear surface of the shingle, an adhesive coating is applied that is of greater thickness than is ordinary applied to the rear surface of the shingle and granules of a larger size than the normal size of sand, limestone, talc, mica, etc. are then applied to the thick coating of adhesive, to at least a portion behind the tab portion of the shingle, and most preferably at least along the lower edge thereof, such that the shingle or shingle layer actually becomes thicker at that location and provides the three-dimensional appearance of a generally thicker shingle.

Accordingly, it is an object of this invention to provide a novel shingle layer of increased thickness, at least at the lower edge of the tab portion of the shingle, by providing on the rear surface of the shingle layer, granules of a larger size than particles that are normally applied to the rear surface of a shingle layer, the granules being embedded in an adhesive coating that has been applied to the rear surface of the shingle layer, which adhesive coating is sufficiently thick to retain the granules adhered to the shingle layer on the rear surface of the shingle layer.

It is another object of this invention to accomplish the above object, wherein the shingle layer comprises a shingle.

It is another object of this invention to apply the adhesive coating to the rear of the shingle layer, against a layer of fine particles of a size range that are normally applied to the rear surface of the shingle, with the layer of fine particles being adhered to a bitumen-coated web of the shingle layer.

It is a further object of this invention to provide a laminated multiple-layer shingle in accordance with the objects set forth above.

Other objects and advantages of the present invention will be readily apparent to those skilled in the art from a reading of the following brief descriptions of the drawing figures, the detailed descriptions of the preferred embodiments and the appended claims.

BRIEF DESCRIPTIONS OF THE DRAWINGS FIGURES

Figure 1:
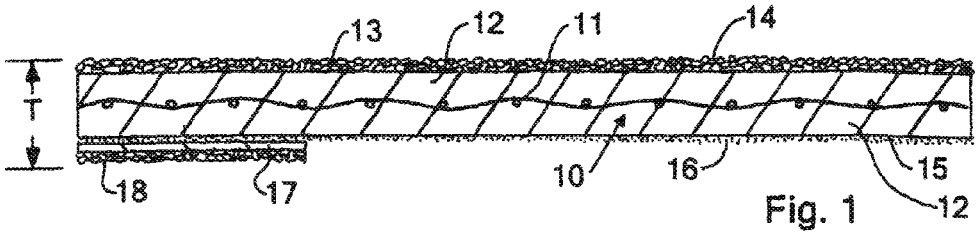
FIG. 1 is a vertical sectional view, taken along line I-I of FIG. 4, through the shingle of FIG. 4, wherein the extra coating of adhesive is shown, having granules embedded therein, applied to the rear surface of a shingle layer, against the layer of fine particles on the rear surface of the shingle, that, in turn, are embedded in the bitumen-coated web.
Figure 3:
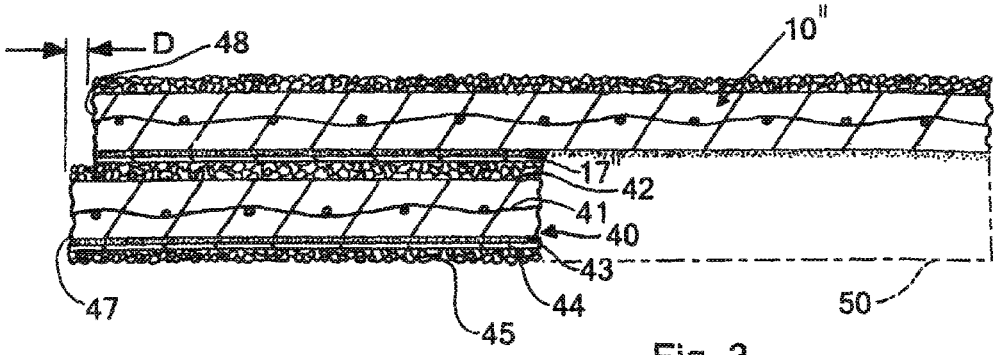

FIG. 3 is a vertical sectional view, taken through a laminated composite shingle, the upper laminate of which is constructed like the embodiment of FIG. 1, but with the rear laminate being applied to the rear surface of the upper laminate also being constructed like the embodiment of FIG. 1, but wherein the rear laminate is adhered to an adhesive coating applied to the fine particles on the rear surface of the upper laminate.

FIG. 4 is the rear surface of a shingle layer in accordance with this invention, wherein the larger granules on the rear surface of the shingle are shown applied along the lower edge of the tab portion of the shingle.

FIG. 5 is an illustration similar to that of FIG. 4, but wherein the larger granules are applied to the rear surface of the shingle in an alternative pattern.

FIG. 6 is an illustration like that of FIG. 5, but wherein the larger granules are applied in yet another alternative pattern.

Figure 7:
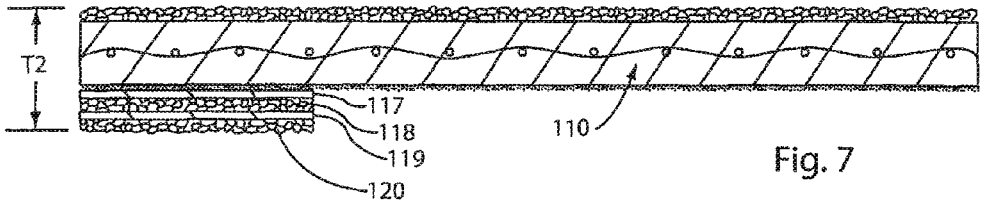

FIG. 7 is an illustration like that of FIG. 3, but having a second overlay comprised of a fourth adhesive coating and another layer of granules attached to the first overlay on the rear surface.

Figure 8:
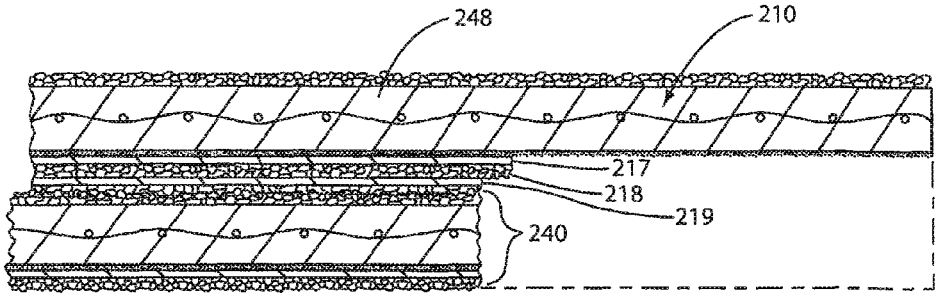

FIG. 8 is an illustration similar to that of FIG. 3, but wherein the top shingle layer of the laminated shingle has an overlay on its rear surface, comprised of an adhesive layer and a layer of granules.

DETAILED DESCRIPTIONS OF THE PREFERRED EMBODIMENTS

Referring now to FIG. 1 in detail, it will be seen that the shingle layer generally designated by the numeral 10 comprises a bitumen-coated web 11, with the bitumen illustrated by the numeral 12.

Conventional granules 13 appear on the front surface 14 of the shingle layer.

The rear surface 15 of the shingle layer 10 has small particles 16 embedded in the bitumen 12, in the conventional manner. Such small particles comprise sand, limestone, talc, mica, or like other small particles, or the like.

The granules 13 on the front surface of the shingle layer are generally of a size range from about 0.3 to about 3 mm, and preferably from about 0.4 to about 2.5 mm.

The small particles 16 on the rear surface 15 of the shingle layer are generally of a size range from about 0.05 to about 0.6 mm, and preferably from about 0.1 to about 0.5 mm.

A layer of adhesive coating 17 is provided against the rear surface onto the fine particles 16, as shown in FIG. 1, with such adhesive coating generally preferably being an asphalt or bitumen, and of a thickness within the range of about 0.1 to about 2 mm, preferably from about 0.2 to about 1.5 mm. Granules 18 are applied to the adhesive coating 17 on the rear surface of the shingle layer, with the granules 18 being of a size range from about 0.3 to about 3 mm, preferably from about 0.4 to about 2.5 mm, more preferably from about 0.5 to about 2 mm, and being embedded in the adhesive coating 17. Generally, the adhesive coating 17 is at least about one fourth of the average particle size of the granules 18 in thickness, and more preferably at least about one third the average particle size of the granules 18 in thickness. Although not required, the thickness of coating 17 is preferably less than the size of the largest granules 18 applied to the adhesive coating 17.

It will be seen that the shingle layer of FIG. 1 thus provides, as shown in FIG. 4, an area on the rear surface 20 of the shingle layer, along the lower edge 21 of the first zone 19 covered by the granules 18, an enhanced thickness portion of the shingle, as a portion of the tab portion 23 of the shingle layer, above the tab lower edge 21.

The tab portion 23 of the shingle layer of FIG. 4, as shown, comprises a plurality of tabs 24, 25, 26, separated by spaced-apart slots, 27 and 28. The portion of the shingle layer rear surface 20 above the tabs 24, 25 and 26, that extends from the upper ends 30 and 31 of the slots 27, 28, to the upper edge 32 of the shingle layer, comprises the butt portion 33 of the shingle layer. End edges 34 and 35 connect the upper edge 32 of the butt portion and the lower edge 21 of the tab portion.

It will be seen that the thickness T of the entire shingle layer 10 of FIG. 1, for at least that portion which includes the added granules 18 and adhesive coating 17 underlying the lower surface 15 of the shingle layer 10, is substantially uniform.

Figure 2:
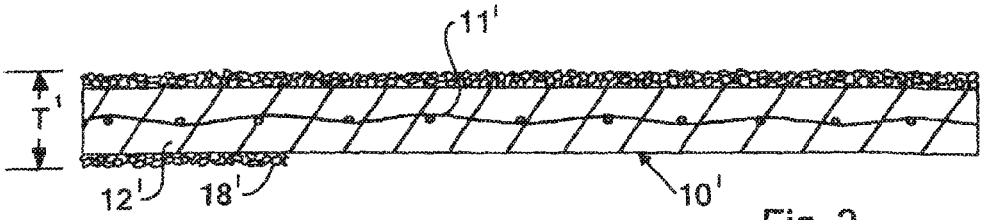
FIG. 2 is a vertical sectional view, like that of FIG. 1, but wherein the layer of granules are applied directly to the bitumen-coated web on the rear surface of the shingle.

With reference now to FIG. 2, an alternative embodiment for the shingle layer of FIG. 1 is illustrated, having a similar construction to the embodiment illustrated in FIG. 1, except that the granules 18' are not applied to a separate adhesive coating on the rear surface of the shingle layer, but, rather, are applied directly to the bitumen 12' of the bitumen coated web 11'. In all other respects, the construction of FIG. 2 is the same as that of FIG. 1. However, it will be noted that the thickness T' of that portion of the shingle layer of FIG. 2 in which the granules 18' are applied to the rear surface, is of a different thickness than the thickness T of the shingle layer of FIG. 1, albeit also of a substantially uniform thickness T'.

In some embodiments, a further layer of granules (not shown) may optionally be adhered to at least some portions of the first layer of granules 18' by means of a further adhesive layer. Such a second overlay can provide an additional aesthetic effect of enhanced apparent thickness, such regions employing a second overlay being of a substantially uniform thickness.

With reference now to the embodiment of FIG. 3, it will be seen that a shingle layer 10" is constructed like that of the shingle layer 10 of FIG. 1, except that, rather than having granules 18 applied to the rear surface as shown in FIG. 1 against and embedded in an adhesive 17, another complete layer of shingle material 40 is applied to the adhesive layer 17". The complete layer 40 of shingle material is constructed of a bitumen coated web 41 having granules 42 on an upper surface thereof as shown in FIG. 3, adhered to the adhesive 17", with a layer of fine particles 43 of the sand, talc, mica, limestone or other type applied to its undersurface, with a layer of adhesive 44 therebeneath, holding a layer of granules 45 thereto. The layer of granules 45 will comprise granules of a size range of about 0.3 to about 3 mm, as may the layer of granules 42.

In the embodiment of FIG. 3, it will be noted that the posterior shingle layer 40 is thus adhered to the anterior shingle layer 10", with the layer 40 having its lower edge 47 extending beyond, or below, the lower edge 48 of the anterior shingle layer 10", amount "D", to yield a "petticoat" effect, providing increased visual thickness for the overall shingle. Such a "petticoat" effect is optional and may be variably controlled in the assembly during construction of a laminated shingle having a plurality of shingle layers. In some instances, it may be desirable for the amount of extension "D" to take on negative values, whereby the lower edge 47 of the layer 40 is recessed beneath the lower edge 48 of the anterior shingle layer 10". Suitable amounts of extension "D" can range from 0 to about 5 cm in absolute value, depending on the visual effect desired.

It will also be understood that the posterior shingle layer 40 may, if desired, cover only a portion of the anterior shingle layer 10", as shown in solid lines in FIG. 3, or may cover the entirety of the rear surface of the anterior shingle layer 10", as shown in phantom at 50, in FIG. 3.

With reference to FIG. 5, it will be seen that a shingle layer 60 is provided, with additional granules of the type 18 applied thereto, on adhesive coatings (unnumbered), in the form of a plurality of generally horizontal stripes 61-64.

With reference to FIG. 6, it will be seen that a shingle layer 65 is provided, with granules similar to those 18 of FIG. 4 applied to the rear surface thereof, embedded in an adhesive coating (unnumbered), in the form of a generally rectangular grid pattern 66.

In FIG. 7, the shingle layer 110 is like that layer 10 of FIG. 1, except that the third adhesive coating 117 on the rear surface of the shingle layer, with its layer 118 of granules therebeneath comprises a first overlay on the rear surface, and wherein there is another adhesive coating 119 adhered to the layer of granules 118, with another layer of granules 120 of approximately the same size as the granules that comprise the granule layer 118, with the adhesive layer 119 and the layer 120 of granules comprising a second overlay on the rear surface of the shingle layer 110, at an overall thickness of "$T''^2$".

FIG. 8 illustrates a laminated shingle 210, similar to the laminated shingle 10" of FIG. 3, but wherein an adhesive layer 217 is disposed on the rear surface of the top shingle layer 248, with a layer of granules 218 adhered to the adhesive layer 217, and wherein another adhesive layer 219 is disposed beneath the layer 218 of granules, with a complete layer of shingle material 240 adhered thereto, like the layer 40 of shingle material of FIG. 3.

It will be apparent from the foregoing that various other patterns for application of the larger granules may be applied to various portions of the rear surface of the shingle layer, as may be desired.

It will be understood that, in accordance with this invention, the shingle layer has been defined as including a tab portion and a butt portion. The tab portion of the shingle may comprise a plurality of tabs separated by spaced-apart slots, as shown in the embodiments of FIGS. 4-6, or the tab portion may comprise a single tab, having no slots separating the tab portion into smaller individual tabs, all within the scope of the invention as claimed. It will also be understood that alternatively, the tab portion could optionally have cutout regions in one or more layers of the shingle construction, exhibiting a dragon's tooth effect, in a multilayer shingle, such cutout regions, when employed, being present in at least a top layer and optionally through one or more lower layers of the construction.

In accordance with this invention, the layer of granules that is applied as an overlay to the rear surface of the shingle layer can be less expensive granules, in that, because they would not normally be directly exposed to the elements, including sunlight, they need not be specially colored, nor have other treatments, such as anti-fungal properties, ultraviolet resistance properties, etc. This provides an economic benefit in the manufacture of a shingle or shingle layer, while achieving an increased thickness for that portion of a shingle/shingle layer that is visible to an observer.

It will be apparent from the foregoing that various modifications may be made in the details of construction, as well as in the use and operation of the invention as set forth in the appended claims.

What is claimed is:

1. A laminated shingle comprising anterior and posterior shingle layers, adhered together, each having a front surface and a rear surface and comprising bitumen-coated fiberglass webs:

(a) with the front surface of the anterior layer having a tab portions normally exposed when in use on a roof;

(b) with the front surface of the anterior layer having a butt portion normally unexposed when in use on a roof;

(c) with the rear surface of the anterior layer having a first zone behind said tab portion and a second zone behind said butt portion;

(d) with the anterior layer having a front surface of granules of a first size range of about 0.3 mm to about 3 mm on at least the tab portion of the front surface of the anterior layer adhered to a first adhesive coating of the bitumen-coated fiberglass web, wherein the front first layer of granules has characteristics selected from any of the following:

(i) color;

(ii) light reflectivity;

(iii) fungus resistance;

(iv) ultra-violet reflectiveness; and (v) infrared reflectiveness;

(e) with the rear surface of the fiberglass web of the anterior shingle layer having a thin second adhesive coating of a thickness of about ¼ to about ⅓ of the average size of granules of clause (d);

(f) a layer of fine granules of a second size range, smaller than said first size range and of a size range of about 0.05 mm to about 0.6 mm, on the rear surface of the fiberglass web of the anterior shingle layer, embedded in the thin second adhesive, with the layer of fine particles being comprised of any of the group of:

(i) sand;

(ii) limestone;

(iii) talc; and (iv) mica; and (g) wherein there are slots between tab portions of the anterior shingle layer;

(h) wherein the posterior shingle layer has a front surface comprised of granules of a size range of clause (d);

(i) wherein the rear surface of the fiberglass web of the posterior shingle layer also has a thin second adhesive coating of a thickness of the adhesive coating of clause (e);

(j) wherein a layer of fine granules of a size range of the granules of clause (f) are adhered to the rear surface of the posterior shingle layer; and (k) wherein the anterior and posterior shingle layers are adhered together by any of the following means:

(A) by a third adhesive coating on the rear surface of the anterior shingle layer, directly connected to the granules of clause (h); and (B) by a third adhesive coating on the rear surface of the anterior shingle layer that has an additional layer of granules connected therebeneath and a fourth adhesive coating beneath the additional layer of granules, with the posterior shingle layer connected to the fourth adhesive coating.

2. The shingle of claim 1, wherein the lower edge of the posterior shingle layer extends downwardly beyond the lower edge of the anterior shingle layer, in a petticoat effect.

3. The shingle of claim 2, wherein the extension of the lower edge of the posterior shingle layer is up to about 5 cm.

4. The shingle of claim 1, wherein the anterior and posterior shingle layers are adhered together by the means of clause (k) (A).

5. The shingle of claim 1, wherein the anterior and posterior shingle layers are adhered together by the means of clause (k) (B).

6. The shingle of claim 4, wherein the lower edge of the posterior shingle layer extends downwardly beyond the lower edge of the anterior shingle layer, in a petticoat effect.

7. The shingle of claim 6, wherein the extension of the lower edge of the posterior shingle layer is up to about 5 cm.

8. The shingle of claim 5, wherein the lower edge of the posterior shingle layer extends downwardly beyond the lower edge of the anterior shingle layer, in a petticoat effect.

9. The shingle of claim 8, wherein the extension of the lower edge of the posterior shingle layer is up to about 5 cm.

* * * * *